US009034073B2

(12) United States Patent
Li et al.

(10) Patent No.: US 9,034,073 B2
(45) Date of Patent: May 19, 2015

(54) METHOD FOR MAKING METAL-BASED NANO-COMPOSITE MATERIAL

(75) Inventors: Wen-Zhen Li, Beijing (CN); Shi-Ying Liu, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 600 days.

(21) Appl. No.: 13/323,767

(22) Filed: Dec. 12, 2011

(65) Prior Publication Data

US 2013/0098208 A1 Apr. 25, 2013

(30) Foreign Application Priority Data

Oct. 21, 2011 (CN) ..... 2011 1 0322843

(51) Int. Cl.

| | |
|---|---|
| ***C22B 9/16*** | (2006.01) |
| ***C22C 47/08*** | (2006.01) |
| ***C22C 49/14*** | (2006.01) |

(52) U.S. Cl.

CPC ..... *C22C 47/08* (2013.01); *C22C 49/14* (2013.01); *B22F 2999/00* (2013.01); *Y10S 977/773* (2013.01); *Y10S 977/90* (2013.01)

(58) Field of Classification Search

CPC ..... B01F 11/0258; B01F 13/0845; B01F 15/00006; B01F 15/00389; B01F 15/00707; B01F 15/0072; B01F 2215/0427; B01F 2215/0413; B01F 2215/0454; B01F 2215/0477; B01F 2215/481; B01F 7/00541; B01F 7/008

USPC ..... 428/539.5; 75/343, 351; 977/773, 900

See application file for complete search history.

(56) References Cited

U.S. PATENT DOCUMENTS

| | | | | |
|---|---|---|---|---|
| 3,936,298 | A * | 2/1976 | Mehrabian et al. | 148/400 |
| 6,860,314 | B1 * | 3/2005 | Koide et al. | 164/113 |
| 8,287,622 | B2 * | 10/2012 | Li et al. | 75/684 |
| 2008/0127777 | A1 * | 6/2008 | Motegi et al. | 75/342 |
| 2008/0289727 | A1 * | 11/2008 | Angeliu | 148/404 |
| 2011/0154953 | A1 | 6/2011 | Li et al. | |

FOREIGN PATENT DOCUMENTS

| | | |
|---|---|---|
| CN | 101564604 | 10/2009 |
| CN | 102108455 | 6/2011 |

(Continued)

OTHER PUBLICATIONS

Machine translation of CN 101564604 A published Oct. 28, 2009.*

*Primary Examiner* — George Wyszomierski
*Assistant Examiner* — Tima M McGuthry Banks
(74) *Attorney, Agent, or Firm* — Novak Druce Connolly Bove + Quigg LLP

(57) ABSTRACT

A method for making a metal-based nano-composite material is disclosed. In the method, a semi-solid state metal-based material is provided. The semi-solid state metal-based material is stirred and nano-sized reinforcements are added into the semi-solid state metal-based material to obtain a semi-solid state mixture. The semi-solid state mixture is heated to a temperature above a liquidus temperature of the metal-based material, to achieve a liquid-metal-nano-sized reinforcement mixture. The liquid-metal-nano-sized reinforcement mixture is ultrasonically processed at a temperature above the liquidus temperature by conducting ultrasonic vibrations to the liquid-metal-nano-sized reinforcement mixture along different directions at the same time.

17 Claims, 3 Drawing Sheets

(56) References Cited

FOREIGN PATENT DOCUMENTS

| | | |
|---|---|---|
| JP | H09239317 | 9/1997 |
| JP | 2005334256 | 12/2005 |
| TW | 201134949 | 10/2011 |

* cited by examiner

METHOD FOR MAKING METAL-BASED NANO-COMPOSITE MATERIAL

CROSS-REFERENCE TO RELATED APPLICATIONS

This application claims all benefits accruing under 35 U.S.C. §119 from China Patent Application No. 201110322843.X, filed on 2011 Oct. 21, in the China Intellectual Property Office, the disclosure of which is incorporated herein by reference.

BACKGROUND

1. Technical Field

The present disclosure relates to methods for making metal-based composite materials, and particularly relates to a method for making metal-based nano-composite material.

2. Description of Related Art

Metal-based composite materials have wide applications in aviation, vehicles, and information technology for the good specific strength, specific stiffness, abrasion resistance, and high temperature resistance. The performance of the metal-based composite material relates to a size of reinforcements dispersed in the metal-based composite material. Nano-sized reinforcements with a small amount can greatly improve the performance of the metal-based composite material. However, the small size of the nano-sized reinforcements makes the surface energy and surface tension of the nano-sized reinforcements very high. Thus, the nano-sized reinforcements tend to aggregate with each other and are very difficult to be uniformly dispersed in the metal-based material. Stir casting is a conventional technology for preparing metal-based composite material containing relatively large sized reinforcements. However, when using the stir casting method to prepare metal-based nano-composite material, the nano-sized reinforcements are hardly dispersed in the metal material, and are prone to be aggregated and clustered together.

Ultrasonic processing can disperse the reinforcements at a local place in the metal material. During the ultrasonic processing, an amplitude transforming rod is inserted into a mixture of the melt metal and the reinforcements. The end of the amplitude transforming rod can conduct an ultrasonic vibration to the mixture. An ultrasonic vibration can disperse the reinforcements adjacent to the end of the rod. However, when the amount of the mixture is large, the reinforcements away from the end of the rod cannot be sufficiently dispersed. By using this method, serious clustering and aggregation of the nano-sized reinforcements can be found in the composite material especially when the amount of the composite material is larger than 10 kilograms. The non-uniform dispersion of the nano size reinforcements greatly deteriorates the performance of the composite material.

What is needed, therefore, is to provide a method for making a metal-based nano-composite material by which a great quantity of material can be processed simultaneously while nano-sized reinforcements can be dispersed uniformly.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
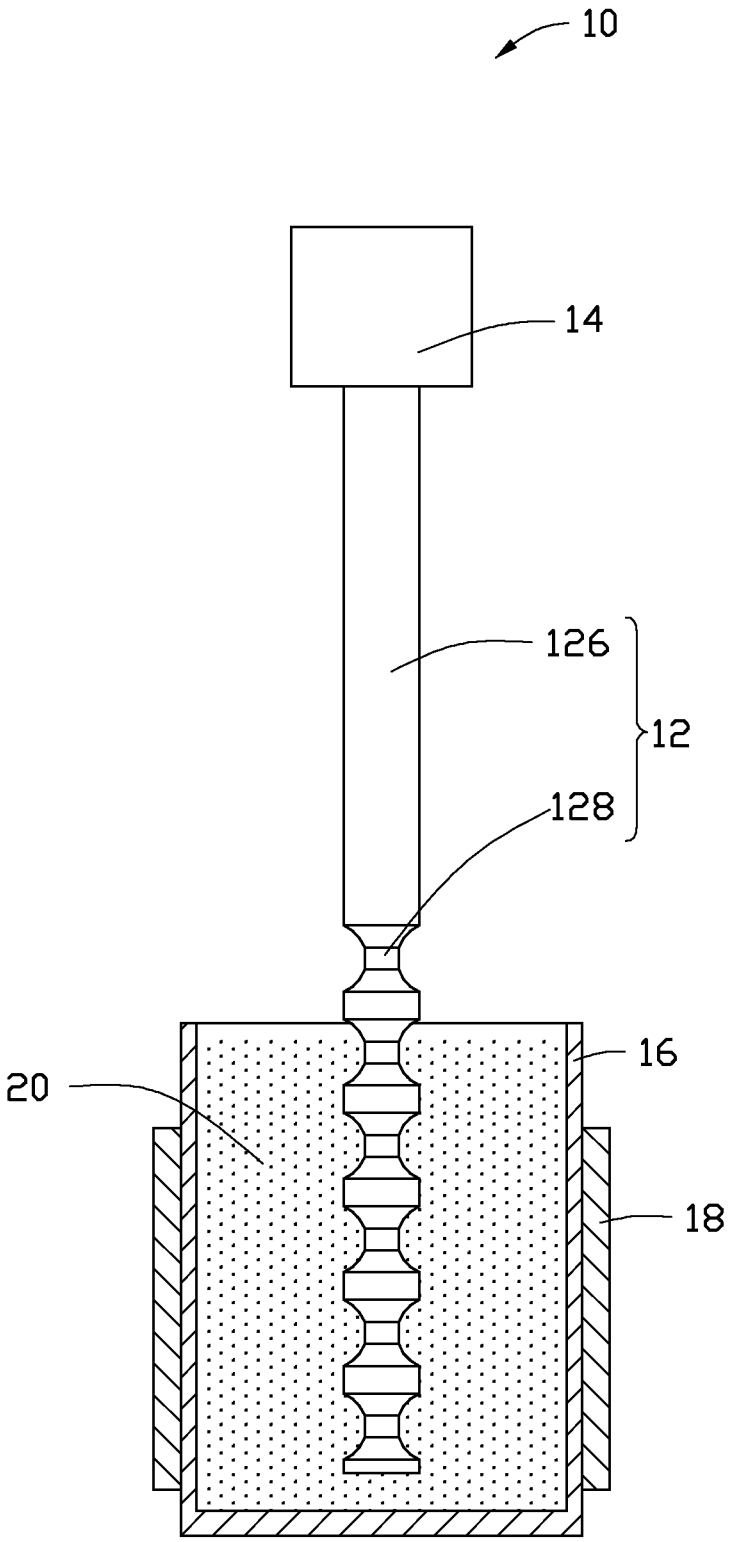
FIG. 1 is a schematic view of an embodiment of a multi-dimension high power ultrasonic apparatus.

Referring to FIG. 1, an embodiment of a multi-dimension high power ultrasonic apparatus 10 includes an amplitude transformer 12 and a high power ultrasonic wave generator 14. The high power ultrasonic wave generator 14 can generate high power ultrasonic vibration. The amplitude transformer 12 conducts the high power ultrasonic vibration to a medium that is in contact to the amplitude transformer 12 and increases the amplitude of the high power ultrasonic vibration up to a desired level. The amplitude transformer 12 has a rod shape with two opposite ends. In one embodiment, the amplitude transformer 12 has a cylinder shape with varied diameter. The amplitude transformer 12 can have a longitudinal axis. One end of the amplitude transformer 12 is connected to the high power ultrasonic wave generator 14.

The amplitude transformer 12 along the length, can be divided into at least two sections including a radiating portion 128 and an extending portion 126 connected to the radiating portion 128. The extending portion 126 is located between the radiating portion 128 and the high power ultrasonic wave generator 14. One end of the extending portion 126 is connected to the radiating portion 128, and the other end of the extending portion 126 is connected to the high power ultrasonic wave generator 14. In use, the radiating portion 128 is immersed into a mixture of a melted metal and nano-sized reinforcements, to conduct the high power ultrasonic vibration to the mixture. The extending portion 126 is exposed from the mixture, to keep the high power ultrasonic wave generator 14 away from the mixture for a distance, for avoiding the melted metal overheating the high power ultrasonic wave generator 14. By using the extending portion 126, the high power ultrasonic wave generator 14 does not need any cooling device or heat dissipating device, thus can have a simple structure and low cost.

The extending portion 126 can dissipate heat conducted from the radiating portion 128 to avoid the heat being conducted to the high power ultrasonic wave generator 14. The extending portion 126 has enough length and a good heat dissipating effect to dissipate the heat coming from the radiating portion 128. The material of the extending portion 126 can be metal having relatively good heat dissipating effect. For example, the metal can have a relatively good heat conductivity, such as copper, aluminum, silver, or alloys thereof.

In another embodiment, the extending portion 126 can insulate the heat conduction from the radiating portion 128 to the high power ultrasonic wave generator 14. The extending portion 126 has an enough length and a good heat insulating effect to insulate the heat conduction from the radiating portion 128. The material of the extending portion 126 can be a ceramic material having relatively good heat insulting effect, such as silicon oxide, silicon carbon, aluminum oxide, or combinations thereof.

The extending portion 126 can have a rod shape, such as a cylinder shape. The length of the extending portion 126 can be set by the temperature of the mixture. In one embodiment, the length of the extending portion 126 is about 10 centimeters (cm) to about 60 cm.

The extending portion 126 and the radiating portion 128 can be two sections belonging to an integrated structure having the same shape and/or material. The extending portion 126 and the radiating portion 128 can also be two individual segments joined together, and the extending portion 126 and the radiating portion 128 can have different materials and/or shapes. In one embodiment, the material of the extending portion 126 is metal, and the material of the radiating portion 128 is ceramic.

The radiating portion 128, along a length, can be divided into at least two main sections and a connecting section. The connecting section is located between the two main sections and connects the two main sections at two opposite ends. The main sections can conduct the ultrasonic vibration in the radiating portion 128, and the connecting section can conduct the ultrasonic vibration from the radiating portion 128 to the mixture. The outer surface (i.e., sidewall) of the at least two main sections both parallel lengthwise to the radiating portion 128. The at least two main sections can be coaxially arranged, and have different cross-sections. The cross-sections of the two main sections of the radiating portion 128 can have different areas and/or shapes. The shape of the cross-sections of the two main sections can be round, ellipse, triangle, rectangle, or polygon.

The connecting section has an outer surface (i.e. sidewall) that is not parallel to the length direction of the radiating portion 128. The outer surface of the connecting section can be a smooth surface connected between the outer surfaces of the two main sections. In one embodiment, the outer surface of the connecting section can have a curved surface smoothly extending from the outer surface of the one main section to the outer surface of the other main section. The connecting section is a multi-dimension radiation section that can conduct the ultrasonic vibration to the mixture along multiple directions. More specifically, the connecting section not only can conduct the ultrasonic vibration along a direction parallel to the length of the radiating portion 128, but also can conduct the ultrasonic vibration along directions parallel to tangents of the outer surface of the connecting section. The outer surface of the connecting section is curved and has different tangents at different places. The ultrasonic vibrations are emitted to the mixture along the tangent directions of the places on the outer surface of the connecting section. Therefore, the connecting section can conduct the ultrasonic vibration to the mixture, and the ultrasonic vibration along multiple directions can cover the entire circumstance around the radiating portion 128. The end of the radiating portion 128 away from the extending portion 126 (i.e., the end of the amplitude transformer 12 away from the high power ultrasonic wave generator 14) can have a bottom surface. In addition, the ultrasonic vibration can be emitted from the bottom surface to the mixture along the direction parallel to the length direction of the radiating portion 128.

The radiating portion 128 can include a plurality of connecting sections. To improve the multi-dimension radiation of the radiating portion 128, the total length of the plurality of connecting sections can be relatively large. For example, the total length of the plurality of connecting sections can take a percentage of about 40% to about 60% of the length of the radiating portion 128. This percentage cannot be too small to decrease the multi-dimension radiation, and cannot be too large to decrease the conduction of the ultrasonic vibration in the main sections of the radiating portion 128. The material of the radiating portion 128 can be metal having suitable thermal resistance and stiffness, such as titanium alloy, nickel alloy, cobalt alloy, or iron alloy.

Figure 2:
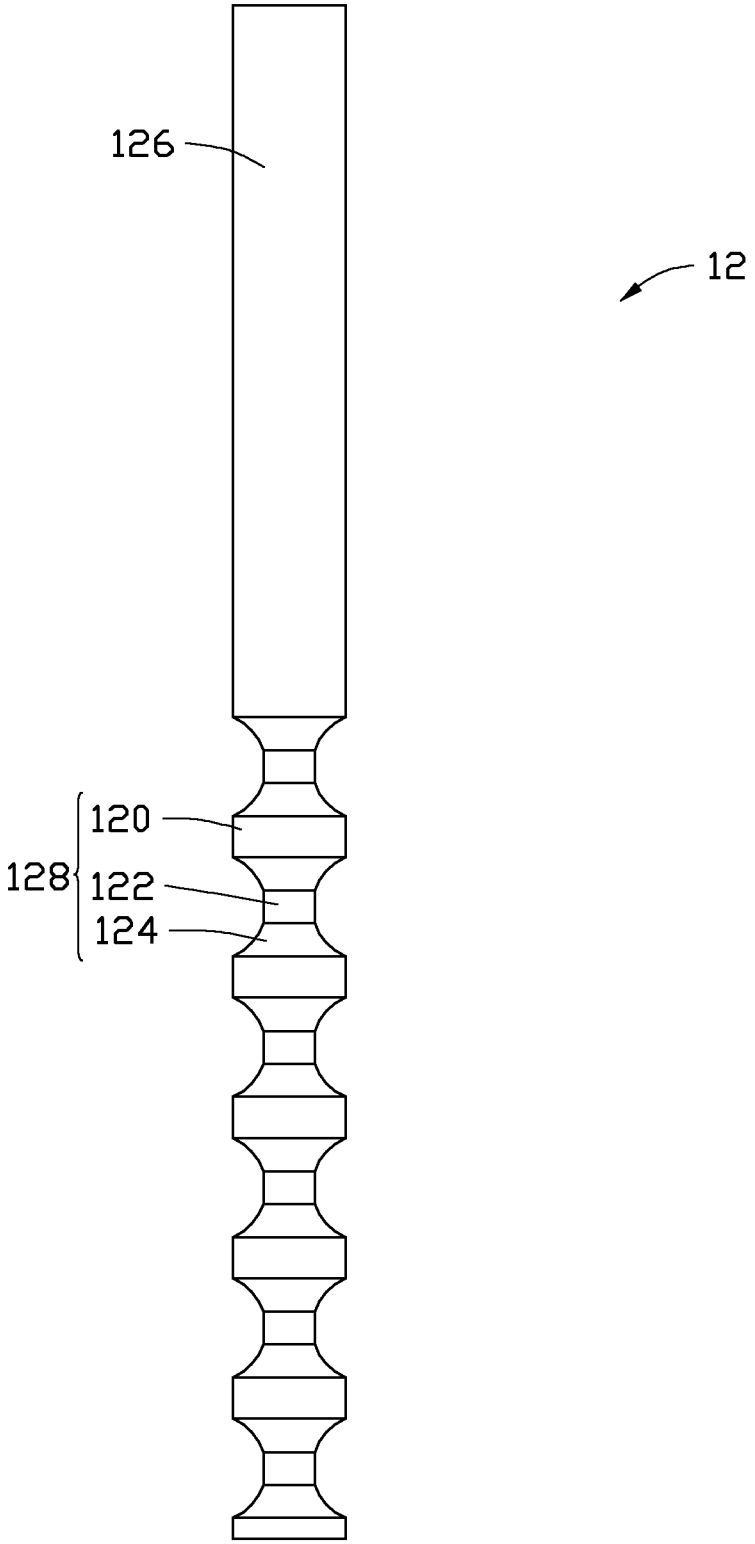
FIG. 2 is a schematic view of an embodiment of an amplitude transformer of the multi-dimension high power ultrasonic apparatus.

Referring to FIG. 2, the radiating portion 128 can include at least one first main section 120, at least one second main section 122, and at least one connecting section 124 connecting the first main section 120 and the second main section 122 together. The first main section 120 and the second main section 122 can be coaxially arranged and have cylindrical rod shapes. The area of the cross-section of the first main section 120 is larger than the area of the cross-section of the second main section 122. The connecting section 124 can be coaxially arranged with the first and second main sections 120, 122. The connecting section 124 can have a shape of a frustum (e.g., a frustum of a cone). The outer surface of the connecting section 124 is connected between the outer surface of the first main section 120 and outer surface of the second main section 122.

In one embodiment, the amplitude transformer 12 includes a plurality of first main sections 120, a plurality of second main sections 122, and a plurality of connecting sections 124 connected between the plurality of first main sections 120 and the plurality of second main sections 122. The outer surface of the connecting sections 124 can be concave surfaces. The concave surfaces of the connecting sections 124 conduct ultrasonic vibration along different directions, thus covers the entire circumstance around the radiating portion 128.

In one embodiment, the connecting section 124 and the second main section 122 have the same length. A total length of two connecting section 124 and one second main section 122 is about 50 millimeters (mm). Each of the first main sections 120 is about 20 mm. The total length of the radiating portion 128 is about 350 mm. The diameter of the cross-section of the first main section 120 is about 45 mm. The extending portion 126 and the first main section 120 have the same area and shape of the cross-sections. The extending portion 126 is connected to one first main section 120 located on the end of the radiating portion 128.

Figure 3:
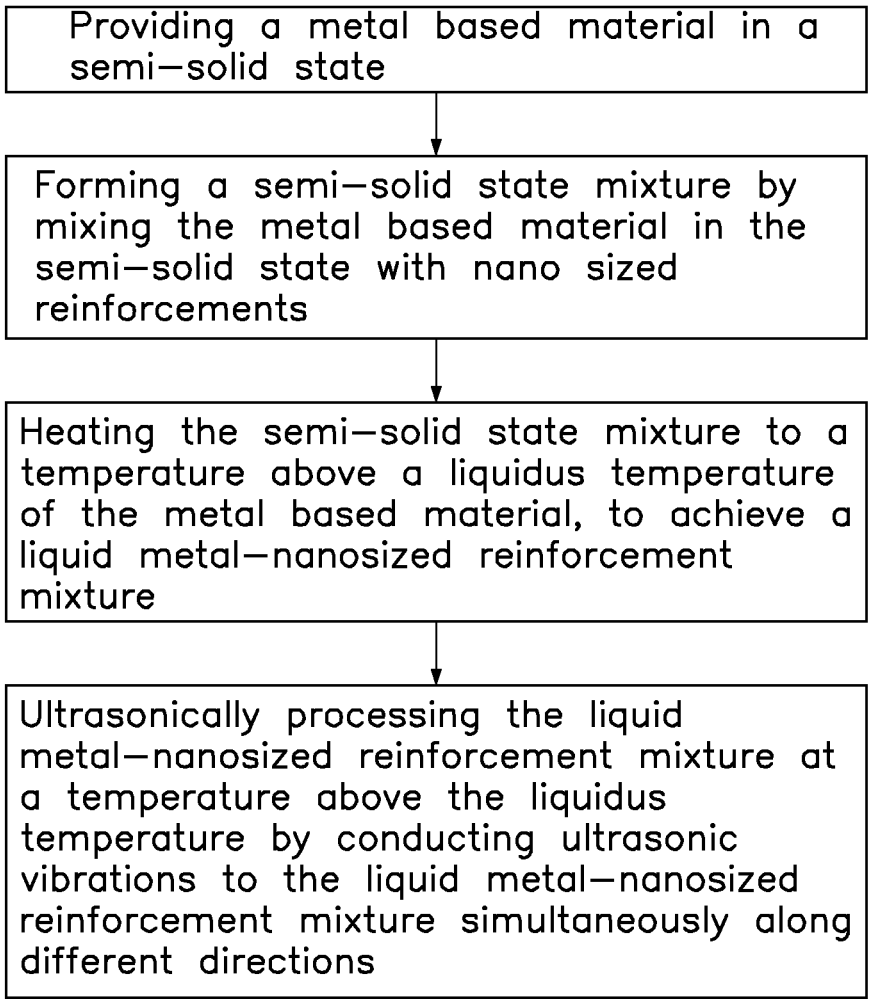
FIG. 3 is a flow chart of an embodiment of a method for making a metal-based nano-composite material.

Referring to FIG. 3, a method for making a metal-based nano-composite material using the above described multi-dimension high power ultrasonic apparatus 10 includes steps of:

S10, providing a semi-solid state metal-based material;

S20, stirring the semi-solid state metal-based material and adding nano-sized reinforcements into the semi-solid state metal-based material to obtain a semi-solid state mixture;

S30, heating the semi-solid state mixture to a temperature above a liquidus temperature of the metal-based material, to achieve a liquid-metal-nano-sized reinforcement mixture 20; and S40, ultrasonically processing the liquid-metal-nano-sized reinforcement mixture 20 at a temperature above the liquidus temperature by conducting ultrasonic vibrations to the liquid-metal-nano-sized reinforcement mixture 20 simultaneously along different directions.

In step S10, the metal-based material can be pure metals or alloys of the metal. The material of the metal can be aluminum (Al), copper (Cu), magnesium (Mg), zinc (Zn), iron (Fe), silver (Ag), platinum (Pt), or any combinations thereof. In one embodiment, the metal-based material is Mg alloy. The metal-based material can be provided in a protective gas or a vacuum. The protective gas or vacuum can prevent the metal-based material from being oxidized or burning. The protective gas can be at least one of nitrogen ($N_2$), carbon dioxide ($CO_2$), sulfur hexafluoride, and a noble gas. In one embodiment, the protective gas is made up of about 98.3% to about 98% $CO_2$ and about 1.7% to about 2.0% sulfur hexafluoride.

In one embodiment, a method for making the semi-solid state metal-based material includes the following steps:

S101, providing a metal-based material in solid state;

S102, heating the metal-based material in solid state to a temperature between a liquidus temperature and a solidus temperature of the metal-based material to obtain a metal-based material in semi-solid state; and

S103, keeping the metal-based material in the semi-solid state for a period of time.

In one embodiment, another method for making the semi-solid state metal-based material includes the following steps:

S111, providing a metal-based material in solid state;

S112, heating the metal-based material in solid state to a temperature 50° C. higher than the liquidus temperature of the metal-based material to obtain a metal-based material in liquid state; and

S113, decreasing the temperature of the metal-based material in liquid state to a temperature between the liquidus temperature and the solidus temperature of the metal-based material to obtain the metal-based material in semi-solid state.

The metal-based material in solid state can be in a form of solid powder or solid block. The metal-based material can be kept in a semi-solid state, in a time ranging from about 10 minutes to about 60 minutes. The metal-based material in solid state can be disposed in a high-temperature resistance furnace 16. A heating member 18, can be disposed outside and around the high-temperature resistance furnace 16 for heating the metal-based material in the furnace 16. The protective gas may be used to protect the metal-based material and nano-sized reinforcements from being oxidized during steps S10 to S40. The solidus temperature quantifies the point at which the metal-based material completely solidifies. The liquidus temperature is the maximum temperature at which metal crystals can co-exist with the melt metal in the metal-based material. Above the liquidus temperature the metal-based material is totally melted. Below the liquidus temperature more and more crystals begin to form in the melt.

In step S20, the nano-sized reinforcements can be carbon nanotubes (CNTs), silicon carbides (SiC), aluminum oxides (Al2O3), boron carbides (B4C) or any combinations thereof. The weight percentage of the nano-sized reinforcements in the metal-based composite material can range from about 0.1% to about 5.0%. In one embodiment, the weight percentage of the nano-sized reinforcements can range from about 0.5% to about 2.0%. The nano-sized reinforcements can be particles with diameters ranging from about 1.0 nanometer to about 100 nanometers. An outer diameter of each CNT can range from about 10 nanometers to about 50 nanometers. A length of each CNT can range from about 0.1 micrometers to about 50 micrometers. Before being added to the semi-solid state metal-based material, the nano-sized reinforcements can be heated to a temperature in a range from about 300° C. to about 350° C. for removing water absorbed by the surfaces of the nano-sized reinforcements. Therefore, the wettability between the nano-sized reinforcements and the metal-based material will be enhanced.

The metal-based material can be stirred during the process of adding the nano-sized reinforcements therein to uniformly disperse the nano-sized reinforcements into all of the metal-based material. The method for stirring the metal-based material can be intense agitation. A method of the intense agitation can be an ultrasonic stirring or an electromagnetic stirring. An electromagnetic stirrer can implement the method of the electromagnetic stirring. A device having a number of agitating vanes can implement the method of the ultrasonic stirring. The agitating vanes can be two-layer type or three-layer type. The speed of the agitating vanes can range from about 200 r/min to about 500 r/min. The time of the intensely agitating can range from about 1 minute to about 5 minutes.

When the metal-based material is stirred, the nano-sized reinforcements are added into the metal-based material slowly and continuously to uniformly disperse the nano-sized reinforcements. If the nano-sized reinforcements are added into the metal-based material all at once, the nano-sized reinforcements will be aggregated to form a number of nano-sized reinforcement clusters. In one embodiment, the nano-sized reinforcements are added into the metal-based material via a steel tube. In other embodiments, the nano-sized reinforcements are added into the metal-based material via a funnel or a sifter having a plurality of nano size holes. By the above methods, the speed of adding the nano-sized reinforcements can be controllable so that the nano-sized reinforcements are dispersed into the metal-based material uniformly.

Since the metal-based material in semi-solid state is soft, the nano-sized reinforcements can be easily added into the metal-based material and prevented from being damaged. Furthermore, since a viscosity of metal-based material in semi-solid state is large, the nano-sized reinforcements are confined in local area of the metal-based material. Therefore, the nano-sized reinforcements can be avoided of floating or sinking. A swirl can be produced when the metal-based material is being stirred. Following the centrifugal force of the swirl motion, the nano-sized reinforcements can be dispersed into all the metal-based material uniformly. Therefore, the nano-sized reinforcements are uniformly dispersed into all the metal-based material in step S20.

In step S30, the semi-solid state mixture can be heated in the protective gas. The temperature of the semi-solid state mixture is increased to a temperature higher than the liquidus temperature of the metal-based material to obtain the liquid-metal-nano-sized reinforcement mixture 20. By increasing the temperature of the furnace 16, the temperature of the semi-solid state mixture can be increased to above 400° C. The dispersal of the nano-sized reinforcements has no change during the processing of heating the semi-solid state mixture.

In step S40, the amplitude transformer 12 can conduct the ultrasonic vibration along multiple directions at the same time. There is no need to pre-vibrate the amplitude transformer 12 before inserting the amplitude transformer 12 into the liquid-metal-nano-sized reinforcement mixture 20. The amplitude transformer 12 can be inserted into the liquid-metal-nano-sized reinforcement mixture 20 in an off state, and then the high-power ultrasonic wave generator 14 can be powered after the amplitude transformer 12 has been inserted into the liquid-metal-nano-sized reinforcement mixture 20. The radiating portion 128 of the amplitude transformer 12 is immersed into the liquid-metal-nano-sized reinforcement mixture 20, and the extending portion 126 is exposed out from the liquid-metal-nano-sized reinforcement mixture 20. A distance between the liquid level of the liquid-metal-nano-sized reinforcement mixture 20 and the end of the amplitude transformer 12 away from the high-power ultrasonic wave generator 14 can be equal to or larger than 30 cm. In one embodiment, the amplitude transformer 12 is vertically arranged in the liquid-metal-nano-sized reinforcement mixture 20.

The ultrasonic processing can uniformly disperse the nano-sized reinforcements in microscopic view. A frequency of the ultrasonic processing can range from about 20 KHz to about 27 KHz. A maximum output power of the processing can range from about 0.8 KW to about 2 KW. A time for the ultrasonic processing can range from about 1 minute to about 60 minutes. The more the nano-sized reinforcements, the longer the time it takes for the ultrasonic processing, and vice versa. In one embodiment, the ultrasonic processing lasts for about 900 seconds.

In the liquid-state of the metal-based material, the viscosity of the liquid-metal-nano-sized reinforcement mixture 20 is small and a fluidity of the liquid-metal-nano-sized reinforcement mixture 20 is good. An ultrasonic cavitation effect is stronger in the liquid-metal-nano-sized reinforcement mixture 20 than in the semi-solid state mixture. The effect of the ultrasonic cavitation can break the nano-sized reinforcement clusters in local areas of the mixture in liquid state. The nano-sized reinforcements are uniformly dispersed in both macroscopic view and microscopic view in step S40.

The amplitude transformer 12 can conduct ultrasonic vibration both from the end of the amplitude transformer 12 and from the side wall of the radiating portion 128. Therefore, the radiating portion 128 can be immersed into the liquid-metal-nano-sized reinforcement mixture 20 to increase the processing rang of the liquid-metal-nano-sized reinforcement mixture 20. The amplitude transformer 12 can process a large amount of the liquid-metal-nano-sized reinforcement mixture 20 at the same time, and uniformly disperse the nano-sized reinforcements in the liquid-metal-nano-sized reinforcement mixture 20. The radiating portion 128 can be immersed entirely or partially in the liquid-metal-nano-sized reinforcement mixture 20. The radiating 128 can include a plurality of connecting sections 124, and each of the connecting sections 124 can conduct ultrasonic vibration to the liquid-metal-nano-sized reinforcement mixture 20 at the same time. Thus, a multi-dimension radiation can be achieved. In the tests, the liquid-metal-nano-sized reinforcement mixture 20 respectively having a weight of 50 kilogram (kg), 50 kg, and 100 kg can be processed by using the above described method to uniformly disperse the nano-sized reinforcements into the liquid-metal-nano-sized reinforcement mixture 20 without aggregation or clustering of the reinforcements.

At a later period of the ultrasonically processing, the temperature of the liquid-metal-nano-sized reinforcement mixture 20 can be further heated to be increased to a casting temperature. The casting temperature can be in a range from 650° C. to 780° C. The more the nano-sized reinforcements, the higher the casting temperature, and vice versa.

The method can further include a step of cooling the liquid-metal-nano-sized reinforcement mixture 20 to solidify the mixture 20. The liquid-metal-nano-sized reinforcement mixture 20 can be cooled in the furnace or previously casted into a mold. The mold can be made of metal and preheated to a temperature of about 200° C. to about 300° C. before casting. The preheated temperature of the mold has an effect on the performance of the metal base nano-composite material. If the preheated temperature of the mold is too low, the mold cannot be entirely filled by the mixture in liquid state, and shrink holes may be formed in the metal-based nano-composite material. If the temperature of the mold is too high, a size of the grains of the metal-based composite material will be too large such that the performance of the metal-based composite material will be reduced.

In the present method, the semi-solid state metal-based material has a relatively high viscosity. By adding the nano-sized reinforcements at this stage, it can be easier to distribute the nano-sized reinforcements in the entire semi-solid state metal-based material uniformly in macroscopic view. In addition, by using the ultrasonically processing step to conduct ultrasonic vibration along different directions at the same time, the nano-sized reinforcements in a large area can be uniformly dispersed in microscopic view in a relatively short time period.

Depending on the embodiments, certain of the steps described in the description and claims may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

It is to be understood that the above-described embodiments are intended to illustrate rather than limit the invention. Variations may be made to the embodiments without departing from the spirit of the disclosure as claimed. The above-described embodiments illustrate the scope of the disclosure but do not restrict the scope of the invention.

What is claimed is:

1. A method for making a metal-based nano-composite material, the method comprising steps of:

providing a metal-based material in a semi-solid state;

forming a semi-solid state mixture by mixing the metal-based material in the semi-solid state with nano-sized reinforcements;

heating the semi-solid state mixture to a temperature above a liquidus temperature of the metal-based material, to achieve a liquid-metal-nano-sized reinforcement mixture; and ultrasonically processing the liquid-metal-nano-sized reinforcement mixture at a temperature above the liquidus temperature by conducting ultrasonic vibrations to the liquid-metal-nano-sized reinforcement mixture simultaneously along different directions;

wherein the ultrasonically processing is processed by using a multi-dimension ultrasonic apparatus comprising:

a ultrasonic wave generator; and an amplitude transformer, connected to the power ultrasonic wave generator at one end, comprising a radiating portion; and the radiating portion, along a length direction of the amplitude transformer, comprises:

at least two main sections having different cross-sections, outer surfaces of the at least two main sections being both parallel to a length direction of the amplitude transformer; and at least one connecting section, the at least one connecting section being connected between the at least two main sections, and the at least one connecting section comprises an outer surface smoothly extending from the outer surface of the one of the at least two main sections to the outer surface of the other one of the at least two main sections.

2. The method of claim 1, wherein the forming the semi-solid state mixture comprising steps of: stirring the metal-based material in the semi-solid state while adding the nano-sized reinforcements into the metal-based material.

3. The method of claim 1, wherein the outer surface of the at least one connecting section is a concave surface.

4. The method of claim 1, wherein a total length of the at least one connecting section takes a percentage of about 40% to about 60% of a length of the radiating portion.

5. The method of claim 1, wherein a distance between a liquid level of the liquid-metal-nano-sized reinforcement mixture and an end of the amplitude transformer away from the ultrasonic wave generator is equal to or greater than 30 centimeters.

6. The method of claim 1, wherein the amplitude transformer further comprises an extending portion, and the extending portion is connected to the ultrasonic wave generator at one end and the radiating portion at the other end.

7. The method of claim 6, wherein the extending portion extends from the liquid-metal-nano-sized reinforcement mixture.

8. The method of claim 1, wherein the ultrasonically processing further comprises steps of: inserting the amplitude transformer into the liquid-metal-nano-sized reinforcement mixture in an off state; and generating the ultrasonic vibrations by the ultrasonic wave generator after the amplitude transformer has been inserted into the liquid-metal-nano-sized reinforcement mixture.

9. The method of claim 1, wherein the providing the metal-based material comprising steps of:

providing a metal-based material in solid state;

heating the metal-based material in solid state to a temperature about 50° C. higher than a liquidus line of the metal-based material to obtain a metal-based material in liquid state;

decreasing the temperature of the metal-based material to a temperature between the liquidus line and a solidus line of the metal-based material.

10. The method of claim 1, wherein a material of the nano-sized reinforcements comprises a material that is selected from the group consisting of carbon nanotubes, silicon carbides, aluminum oxides, boron carbides, and any combinations thereof.

11. The method of claim 1, wherein a weight percentage of the nano-sized reinforcements is about 0.1% to about 5.0%.

12. The method of claim 1, wherein a frequency of the ultrasonic processing ranges from about 15 KHz to about 20 KHz, and a power of the ultrasonic processing is equal to or larger than 0.8 kilowatts.

13. The method of claim 1, wherein a time for the ultrasonic processing ranges from about 1 minute to about 60 minutes.

14. The method of claim 1, wherein an amount of the liquid-metal-nano-sized reinforcement mixture ranges from about 50 kilograms to about 100 kilograms.

15. The method of claim 1, further comprising a step of increasing the temperature of the liquid-metal-nano-sized reinforcement mixture to a casting temperature ranged from about 650° C. to about 780° C.

16. The method of claim 1, further comprising a step of cooling the liquid-metal-nano-sized reinforcement mixture.

17. The method of claim 16, wherein the step of cooling comprises steps of: preheating a mold to a temperature ranging from about 200° C. to about 300° C.; and casting the liquid-metal-nano-sized reinforcement mixture to the mold.

* * * * *